United States Patent [19]

Coffey

[11] Patent Number: 4,940,227

[45] Date of Patent: Jul. 10, 1990

[54] CANOE PADDLING EXERCISE MACHINE

[76] Inventor: Calvin T. Coffey, 48 E. Fifth St., Corning, N.Y. 14830

[21] Appl. No.: 441,285

[22] Filed: Nov. 27, 1989

[51] Int. Cl.[5] ..... A63B 69/06

[52] U.S. Cl. ..... 272/72; 272/128

[58] Field of Search ..... 272/72, 106, 108, 117, 272/118, 125, 97, 93, 141, 142, 128

[56] References Cited

U.S. PATENT DOCUMENTS

| | | | |
|---|---|---|---|
| 420,415 | 1/1890 | Reach | 272/118 |
| 4,154,441 | 5/1979 | Gajda | 272/118 |
| 4,396,188 | 8/1983 | Dreissigacker et al. | 272/72 |
| 4,743,011 | 5/1988 | Coffey | 272/72 |

FOREIGN PATENT DOCUMENTS

| | | | |
|---|---|---|---|
| 1417896 | 8/1988 | U.S.S.R. | 272/72 |

*Primary Examiner*—Stephen R. Crow

*Attorney, Agent, or Firm*—Wall and Roehrig

[57] ABSTRACT

An exercise canoe paddling machine has a frame, a pull cord that passes over an outer pulley and an inner pulley that are mounted on a pivotable pulley arm on the front of the machine, and thence under the machine to rotate a flywheel mounted beneath the frame. The cord is attached to an elongated canoe paddling handle. The pivoting pulley arm moves from side to side to follow movement of the paddling handle. The resistance that is produced during stroking of the handle is directed substantially parallel to the frame axis and to the same side thereof as the paddling handle.

8 Claims, 2 Drawing Sheets

CANOE PADDLING EXERCISE MACHINE

This invention relates to exercise apparatus, and is more particularly directed to aerobic exercise ergometers of the type that includes rowing machines or sculling machines. The invention is directed more specifically to pull-handle type machines in which a subject seated on the machine and, gripping a pull handle, pulls a cord to rotate a flywheel. The flywheel (of either an air-vane or friction type) produces a resistance to the stroking movement for the subject.

Rowing and sculling machines of this general type are described, e.g. in U.S. Pat. No. 4,396,188 and in U.S. Pat. No. 4,743,011. These machines provide an exercise movement that simulates rowing or sculling, the amount of resistance increasing with pace or stroke rate.

Canoeists have long desired an exercise machine on which a subject could exercise or train while simulating the stroke motions of canoe paddling. However, the nature of canoe paddling presents special problems. Canoes are paddled with the paddle on one side or the other of the canoe, and with the force of paddling being applied along line generally parallel to the axis of the canoe, but outside the canoe gunwale. Also, the canoeist typically will swing the paddle periodically from one side of the canoe to the other, paddling several strokes on the left, then several strokes on the right, and so forth.

Kayak paddling presents a problem for similar reasons, because that type of boat is paddled with alternate strokes of the paddle on opposite sides of the boat.

Previous attempts to use a canoe paddling technique on a standard pull-handle machine involved simply connecting the pull cord to the shaft of a paddle handle. With this arrangement, the cord extends back to the handle from a pulley or sheave that is directly in front of the subject. This means that the direction of resistance to the paddling stroke is angled across the bow of the machine, rather than in a line parallel to the machine. Also, because the cord is pulled out at an angle from this pulley, there is a tendency for the cord to jam, or to jump off the pulley. This also tends to abrade the cord.

OBJECTS AND SUMMARY OF THE INVENTION

It is an object of this invention to provide an exercise machine which permits a human subject to exercise by simulating the stroking motions of canoe paddling.

It is also an object of this invention to provide a canoe paddling exercise machine which provides a resistance to the stroking motion on a line that is parallel to the axis of the machine, and which changes the line of resistance from one side of the machine to the other to follow movement of the paddle handle from one side of the machine to the other.

It is a further object of this invention to provide an exercise rowing machine that can be easily converted by the user from a rowing configuration to a canoe paddling configuration, without requiring substantial modification, and without requiring special tools.

In accordance with an aspect of this invention, the exercise machine has a longitudinal frame with a flywheel mounted on it, preferably lying horizontally beneath the frame and behind the position of the rower or subject. A seat positions the subject on the machine for simulating canoe paddling motion using a paddling handle having an elongated shaft. A pull cord attaches at one end to the shaft of this handle, and passes over an outer pulley of a pulley arm at the front end of the machine frame. From here the cord passes to an inner pulley on the pulley arm and thence beneath the machine towards the flywheel. A chain and sprocket drive is connected to the pull cord and to the flywheel to rotate the latter when the handle is stroked aft; a spring return or elastic bungee cord is also coupled to the chain and sprocket drive and to the frame to withdraw the cord when the paddling handle recovers forward between strokes. There is an axial pivot on the front end of the machine on which the pulley arm is swingably mounted for motion about the frame axis from one side of the frame to the other. This permits the outer pulley to follow motion of the paddling handle so that the cord between the handle and the outer pulley is kept to the same side as the handle and more or less parallel to the frame axis. This ensures that the resistance force is on a line parallel to the machine and to one side, which is what is actually experienced in canoe paddling.

The pivot is preferably a hollow tube through which the pull cord passes, and the inner pulley is mounted on the pulley arm so that the pivot axis is on a tangent to the inner pulley. This ensures that the cord between the inner pulley and the flywheel stays on the same pathway regardless of the position of the outer pulley and the paddling handle.

In one practical embodiment, a fixed pulley arm is bolted to a front leg of the machine which is then configured as a rowing or sculling machine. The machine is reconfigured for canoe paddling by unbolting and removing the fixed pulley arm, and replacing it with the pivoting pulley arm assembly of this invention. Then a paddling handle is substituted for the rowing pull handle.

If desired, a non-sliding seat can be used in place of the rowing machine sliding seat, and the number of vanes on the flywheel can be changed. All these operations are carried out with simple tools such as a screwdriver, pliers, and an adjustable wrench.

A double pivoting arm assembly can be used to convert this machine to a kayak simulator.

The above and many other objects, features, and advantages of this invention will become apparent from the ensuing description of a preferred embodiment, when read in conjunction with the accompanying Drawing.

DETAILED DESCRIPTION OF THE PREFERRED EMBODIMENT

Figure 1:
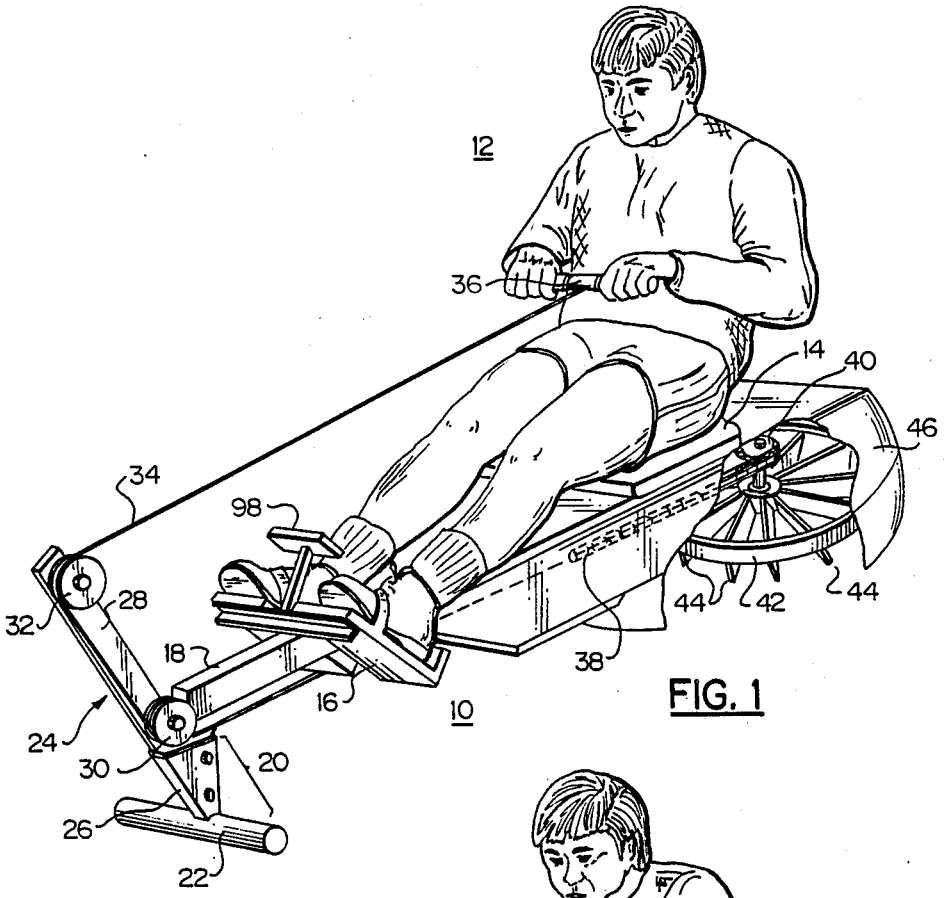
FIG. 1 is a perspective view of a rowing machine according to the prior art, with certain portions exposed.

With reference to the Drawing, and initially to FIG. 1, a pull-handle type rowing machine 10 is in the form of an elongated frame with a human subject 12 for rower positioned on sliding seat 14 on the rowing machine frame. A pair of foot stretchers 16 position the subject's feet. The frame for the rowing machine 10 comprises a longitudinal rail 18 and a front vertical leg 20 that is T-shaped and has a transverse foot 22. There is another frame support on the rear end of the frame behind the rower, but that is hidden in this drawing figure.

A fixed pulley arm is provided in the form of a tower 24 that is angled forward from the front end of the rowing machine 10. A shoe 26 is secured by bolts to the leg 20, and a beam 28 extends generally upwardly from the shoe 26. A lower pulley 30 and an upper pulley 32 are mounted at the base and at the top of the beam 28, respectively. A flexible pull cord 34 extends from a pull handle over the upper pulley 32, and from there down to the lower pulley 30, from which the cord extends rearwardly beneath the rail 18. The cord 34 is connected to a chain 38 that passes over a sprocket 40 which drives a flywheel 42 that is mounted horizontally beneath the rail 18 and rearward or aft of the subject 12. A number of vanes 44 are crimped in place over spokes on the flywheel 42 to induce an air draft upon rotation of the flywheel 42. A shock cord or bungee (not shown) is connected to the chain 38 to draw the chain 38 in the direction to withdraw the cord 34 and the handle 36 between strokes.

A removable shroud 46 is disposed over the flywheel 42 both for safety purposes and to control the air flow through the flywheel.

Figure 2:
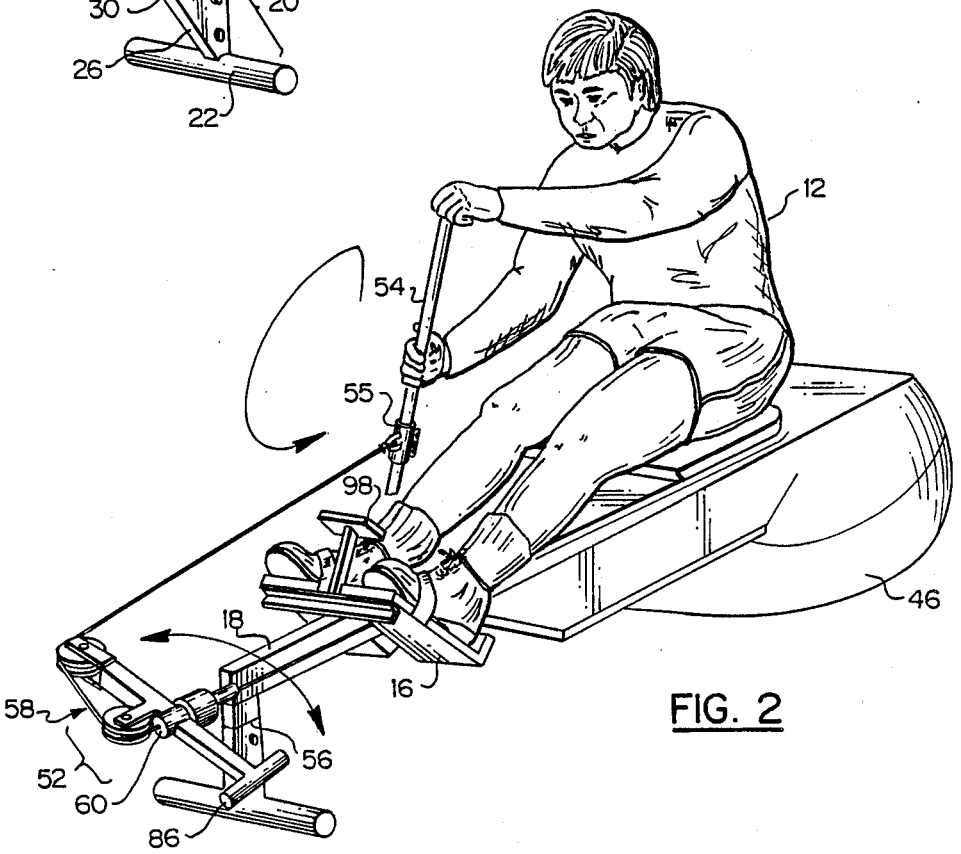
FIG. 2 is a perspective view of a canoe paddling machine according to one embodiment of this invention.

A paddling machine according to the present invention is shown in FIG. 2, and parts therein that are identical with those of the rowing machine of FIG. 1 are identified with the same reference numbers, so that a detailed description can be omitted. In this paddling machine 50, there is a swivel arm assembly 52 that is substituted in place of the pulley arm tower 24 of FIG. 1, and an elongated canoe paddle handle 54 is substituted for the rowing handle 36. In addition, minor changes can be effected in the number of vanes 44. That is, some of the vanes 44 can be removed to adjust the flywheel resistance. Also, the sliding seat 14 can be modified or adapted so as not to slide when the machine is used for canoe paddling.

In this case, the rowing machine 10 can be converted to the paddling machine 50 by unbolting the shoe 26 of the tower 24 from the front leg 20 of the machine, and replacing it with the swivel arm assembly 52. The rowing handle 36, which is attached to the end of the cord 34 by a bolt or clamp is simply removed from the cord, and the cord is attached to the paddling handle 54, for example by a user-adjustable sliding clamp 55.

The swivel arm assembly is basically comprised of a fixed swivel portion 56 that mounts on the front leg 20 of the frame, and a swing pulley arm portion 58 that pivots on the fixed swivel portion 56. The latter has a hollow tubular pivot 60 which the cord 34 passes. The swing arm 58 pivots on the axis of the rowing machine frame, and moves from side to side to follow the paddling handle 54 when the subject 12 changes sides. This means that the flywheel 42 and the cord 34 apply a resistance which is along the line that is parallel to the machine axis and to one side of the machine.

Figure 3:
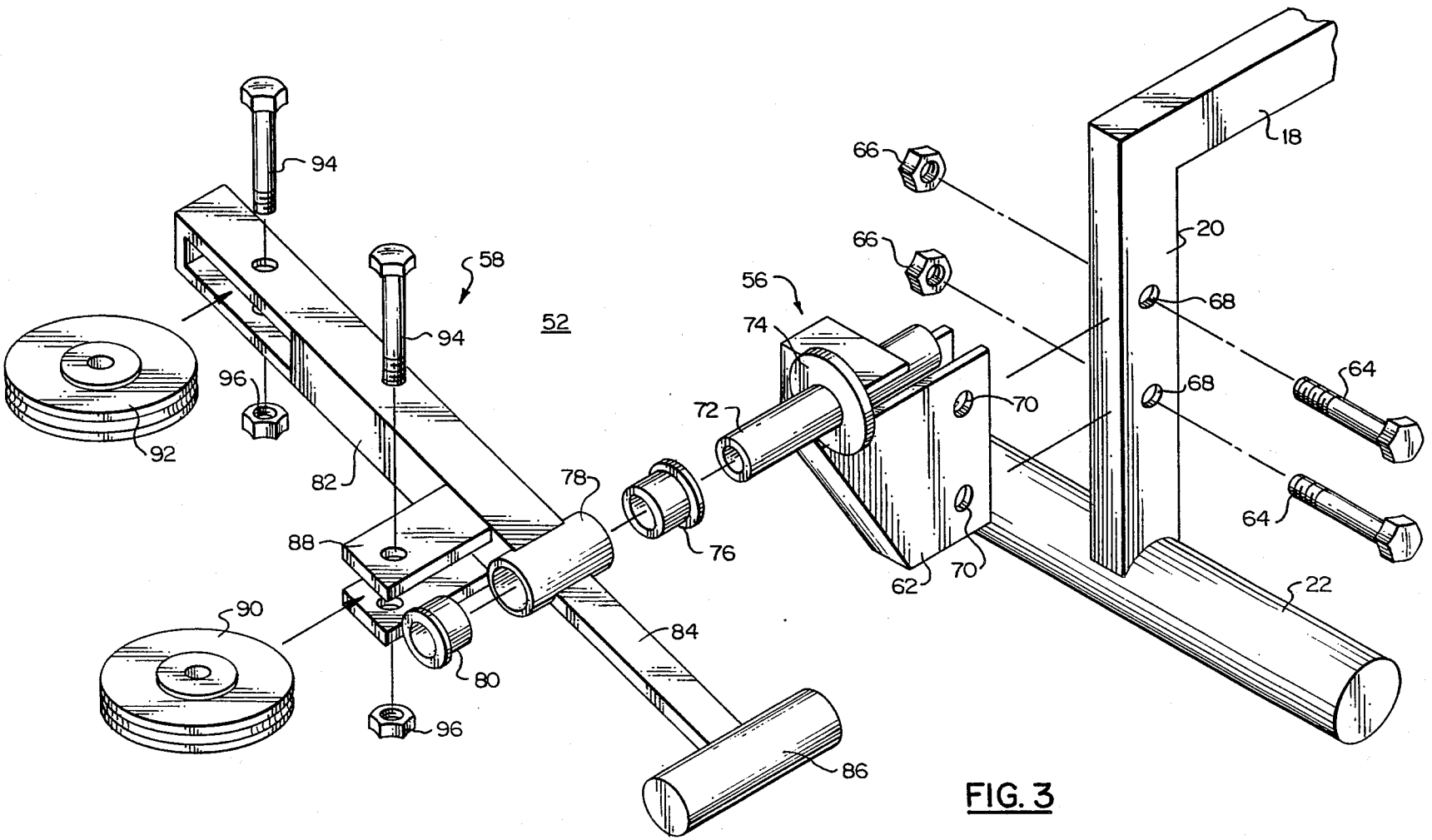
FIG. 3 is an exploded view of the pivotable pulley arm assembly of the FIG. 2 embodiment.

The swivel arm assembly 52 is shown in greater detail in FIG. 3. The fixed swivel portion 56 is comprised of a shoe 62 that fits over the leg 20 and attaches to it by bolts 64 and nuts 56 that pass through holes 68 in the vertical post of the leg 20 and also through corresponding holds 70 in side plates of the shoe 62. The tubular pivot 50 comprises an inner pivot tube 72 that is mounted onto one side plate of the shoe 62. A thrust plate 74 is attached proximally on the pivot tube 72 and a rear bearing 76 is disposed over the inner pivot tube 72.

The swing arm portion 58 has an outer pivot tube 78 that overfits the inner pivot tube 72, and another forward bearing 80 is disposed between the inner and outer pivot tubes 72, 78. A beam 82 projects radially outward from the outer pivot tube 78. A smaller leg 84 projects radially from the tube 78 in the direction opposite to the beam 82 and has a counterpoise or weight 86 which balances the weight of the beam 82.

A forward projecting leg 88 is disposed near the pivot and of the beam 82 and has a inner sheave or pulley 90 mounted thereon while an upper sheave or pulley 92 is mounted at the outer or free end of the beam 82. The sheaves 90 and 92 are pivoted on bolts 94 which are secured by nuts 96.

The leg 88 and lower sheave 90 are positioned such that the cord 34 which passes through the open core of the pivot tubes 72 and 78 is tangent to the sheave 90. This means that the cord that passes back beneath the frame from the inner sheave 90 to the flywheel will remain along the same path regardless of the angular position of the swing arm portion 58. The outer sheave or pulley 92 is free to move, by the swinging of the swing arm 58, from one side of the machine to the other to follow movements of the canoe paddling handle 54.

The length of the counterpoise leg 84 is smaller than the distance from the pivot tubes 72 and 78 to the lower side or base of the foot 22. This feature provides ground clearance for the counterpoise 86, thus permitting the swing arm portion 58 to move from one side of the frame to the other without interference.

Preferably, the paddling handle 54 has a T-shaped upper end and a number of holes through its main shaft so that the cord 34 can be connected in any of a number of positions along its length.

Also, a pacing computer 98 can be included as shown in FIGS. 1 and 2, to provide an indication of simulated canoe speed, paddling pace or rate, pulse rate, and so forth.

In addition, the principles of this invention could be employed to a kayak paddling machine, e.g. by having double pulling arms for two cords, each of which is connected to a respective end of a kayak paddling handle.

While this invention has been described in detail with reference to a preferred embodiment, it should be understood that the invention is not limited to that precise embodiment. Rather, many modifications and variations would present themselves to those skilled in the art without departing from the scope and spirit of this invention, as defined in the appended claims.

What is claimed is:

1. A canoe paddling exercise machine comprising a longitudinal frame; a flywheel mounted on said frame; a seat on said frame on which a human subject is positioned for exercise, simulating canoe paddling motion by stroking an elongated handle against resistance on one or the other side of said frame, a flexible cord that attaches to said elongated handle, a pulley arm positioned at a front end of said longitudinal frame having an outer pulley over which said cord passes to said handle, and an inner pulley over which said cord passes from the outer pulley towards said flywheel; means connected with said cord, said flywheel and said frame for rotating said flywheel in one direction when said handle is stroked aftward to provide resistance to said subject, and to retract said cord towards said flywheel when said handle is recovered forward between strokes; and an axial pivot positioned on a forward end of said frame to permit said pulley arm to swing about a fore-and aft axis so that the outer pulley follows motion of the handle from one side of the frame to the other to produce a resistance during stroking of the handle that is directed substantially parallel to the frame axis, while the inner pulley remains positioned so that the cord passing therefrom towards said flywheel remains substantially in a predetermined path regardless of the position of the swingable pulley arm.

2. The canoe paddling exercise machine according to claim 1 wherein said pivot includes a fixed inner pivot tube attached onto the forward end of said frame and an outer pivot tube that is positioned over said inner pivot tube and is affixed to the pulley arm.

3. The canoe paddling exercise machine according to claim 2 wherein said pivot tubes are aligned with a tangent of said inner pulley, and said cord passes between said inner pulley and said flywheel through said pivot tubes.

4. The canoe paddling exercise machine according to claim 2 wherein said pivot further includes a thrust ring affixed on said inner pivot tube of an aft end thereof.

5. The canoe paddling exercise machine according to claim 1 wherein said pulley arm extends radially from said pivot and a counterpoise is affixed to said pulley arm and extends radially in an opposite direction.

6. The canoe paddling exercise machine according to claim 5 wherein said pivot is disposed a predetermined height above a base of the frame on which the frame rests, and said counterpoise includes a counterweight mounted on a counterpoise arm which is shorter than said predetermined height.

7. An exercise ergometer machine which can be converted from a rowing exercise machine to a canoe paddling exercise machine, comprising a longitudinal frame, a flywheel mounted on said frame, a seat on said frame on which a human subject is positioned for exercising by simulating a rowing motion or by simulating a canoe paddling motion and stroking against resistance; a rowing pull handle; an elongated canoeing handle; a flexible cord that attaches to a desired one of said rowing pull handle and said elongated canoeing handle; a rowing pulley arm that is removably affixable onto a front end of said frame, said rowing pulley arm having an upper pulley over which said cord passes to said rowing pull handle and a lower pulley over which said cord passes from said upper pulley towards said flywheel; means connected with said frame, said flywheel and said cord for rotating said flywheel in one direction when said handle is stroked aftward to provide resistance to said subject, and to retract said cord toward said flywheel when said handle is recovered between strokes; and a swingable paddling pulley arm assembly that includes a fixed member that is removably attachable onto the front end of said frame in substitution for the rowing pulley arm and that has an axial pivot portion fixed thereon, and a pivoting pulley arm member that has an outer pulley over which said cord passes towards said handle an inner pulley over which said cord passes from said outer pulley towards said flywheel, and a pivot member that mates with said axial pivot portion of said fixed member to permit the pulley arm member to swing about a fore-and-aft axis of the frame so that the outer pulley follows motion of said canoeing handle from one side of the frame to the other to ensure that the resistance 0 during stroking of the canoeing handle is directed substantially parallel to the frame axis while the inner pulley remains positioned so that the cord passing therefrom towards said flywheel remains substantially in a predetermined path regardless of the position of said swingable paddling pulley arm assembly.

8. The exercise ergometer machine of claim 7 wherein said pivoting pulley arm member includes a counterpoise arm that projects from said pivot member in the direction opposite to said pulley arm member.

* * * * *